United States Patent [19]

Bush et al.

[11] 4,226,736

[45] Oct. 7, 1980

[54] DISHWASHING DETERGENT GEL COMPOSITION

[75] Inventors: William G. Bush; Valerie D. Braun, both of Cincinnati, Ohio

[73] Assignee: The Drackett Company, Cincinnati, Ohio

[21] Appl. No.: 308

[22] Filed: Jan. 2, 1979

Related U.S. Application Data

[63] Continuation of Ser. No. 490,466, Jul. 22, 1974, abandoned.

[51] Int. Cl.[3] ..... C11D 3/08; C11D 17/00

[52] U.S. Cl. ..... 252/135; 252/174.21; 252/316; 252/317; 252/527; 252/DIG. 1

[58] Field of Search ..... 252/89.1, 174.21, 174.22, 252/317, 135, 527, DIG. 1

[56] References Cited

U.S. PATENT DOCUMENTS

| | | | |
|---|---|---|---|
| 3,060,124 | 10/1962 | Ginn | 252/135 |
| 3,075,922 | 11/1963 | Wixon | 252/539 |
| 3,740,421 | 6/1973 | Schmolka | 424/65 |
| 4,101,457 | 7/1978 | Place et al. | 252/559 |

OTHER PUBLICATIONS

Whistler, Industrial Gums, 2nd Ed., Academic Press, 1973, pp. 698, 708–713.

Hoagland, Rheology of Surface Coatings, R-B-H Dispersions, (1946), pp. 73,20.

Green, Industrial Rheology and Rheological Structures, (1949), Wiley and Sons, pp. 13, 14, 16.

*Primary Examiner*—P. E. Willis, Jr.

*Attorney, Agent, or Firm*—Sharon A. Blinkoff; George A. Mentis

[57] ABSTRACT

A low-foaming machine dishwashing composition comprising an aqueous thickener, a non-ionic surfactant and water, in the form of a gel having a minimum yield point of at least 1170 is disclosed. The dishwashing composition can additionally contain builders such as sequestering agents, pH control agents, and corrosion inhibitors. The use of such compositions in the form of a gel substantially reduces the loss of a portion of the detergent due to leakage from the dishwasher dispenser cup prior to utilization during the washing cycle.

8 Claims, No Drawings

DISHWASHING DETERGENT GEL COMPOSITION

CROSS REFERENCES TO OTHER PATENT APPLICATIONS

This is a continuation of application Ser. No. 490,466 filed July 22, 1974, now abandoned.

BACKGROUND OF THE INVENTION

Cleaning formulations for specific use in machine dishwashers for cleaning soiled plates, glasses, cups, etc. have been disclosed in the prior art (see for example U.S. Pat. Nos. 3,579,455; 3,627,686; 3,673,098; 3,048,548 and 3,549,539). Generally, all of the conventional commercial dishwasher detergents are in the form of a powder and utilize non-ionic surfactants for the control of foam in the dishwasher.

In the course of early development work for the detergent compositions of the present invention, Applicants noted that a substantial amount of the powder detergent is lost from the dishwasher dispenser cup prior to utilization during the main wash cycle. Investigation revealed the cause to be leakage of the detergent from the closed dispenser cup which holds the detergent load for the second or main wash cycle. The dishwasher machines commonly available today operate by using one or two wash cycles followed by rinsing cycles. For those dishwashing machines having only one wash cycle, the dispenser cup remains closed until the beginning of that wash cycle when the detergent is released for cleaning purposes. For those machines having two wash cycles, the dispenser cup remains closed until the beginning of the second or main wash cycle when the detergent is released for cleaning purposes.

Further investigation revealed that all of the currently available commercial granular detergents, as well as powders, suffered from the same problem in varying degrees in different dishwashing machines, depending on the tightness of the dispenser door seal. The looser the fit of the door, the more the water could leak in and flush out the powder prior to utilization during the main wash cycle.

With this problem in mind, and also for the purpose of developing an improved low-foaming dishwasher detergent composition, Applicants carried on further investigative work and unexpectedly discovered that, by formulating the composition in the form of a gel characterized by having a minimum yield point value, the amount of detergent lost from the dispenser cup due to leakage is greatly minimized compared to that for powdered detergents.

Although several U.S. patents disclose liquid detergent formulations having thickeners therein for use in clothes laundry machines or automatic dishwashing machines, there does not appear to be any disclosure concerning this problem related to the leakage of the detergent from the dishwasher dispenser cup. For example, U.S. Pat. Nos. 3,060,124 and 3,075,922 are concerned with the use of thickeners to stabilize the liquid detergents from phase separation. However, these patents do not discuss the functional advantage of the gel form, characterized by having a minimum yield point, over the powders in retaining the detergent in the dispenser cup of an automatic dishwasher machine.

SUMMARY OF THE INVENTION

The present invention provides for a low-foaming dishwashing composition comprising from about 0.1 to 20 weight percent of an aqueous thickener, from about 0.1 to 20 weight percent of a non-ionic surfactant and water wherein the composition is in the form of a gel characterized by having a yield point of at least 1170. The composition can additionally contain a builder.

An embodiment of the invention comprises a dishwashing composition containing from about 0.1 to 20 weight percent of an aqueous thickener; 0.1 to 20 weight percent of a non-ionic surfactant; 1 to 20 weight percent of a corrosion inhibitor; 1 to 70 weight percent of a builder; and the remaining portion constituting water.

A further preferred embodiment of a composition in accordance with the invention contains from about 0.1 to 5 weight percent of sodium carboxymethylcellulose; 1 to 20 weight percent of sodium silicate; 0 to 40 weight percent tetrasodium pyrophosphate; 1 to 30 weight percent of trisodium nitrilotriacetate monohydrate; 10 to 95 weight percent water; and a non-ionic surfactant selected from the group consisting of:

(a) from about 0.1 to 10 weight percent of polypropoxylated-polyethoxylated ethylene glycol having an average molecular weight between about 2100 and 3100, that consists of, by weight, from about 20 to 40 weight percent polyoxyethylene, and a polyoxypropylene portion having a molecular weight between 1700 and 2500;

(b) from about 0.1 to 10 weight percent of a compound having the general formula R—O(A)H wherein: R is an essentially linear alkyl group having from 10 to 18 carbon atoms, with the proviso that at least 70 weight percent of said compounds in said mixture have an R of from 12 to 16 carbon atoms, and A is a mixture of oxypropylene and oxyethylene groups, said oxypropylene and oxyethylene groups being from 55 percent to 80 percent of the total weight of the compounds, the oxypropylene to oxyethylene ratio of said total weight being from 0.85:1 to 2.75:1, and (c) mixtures thereof.

A further embodiment of the invention provides for a method for reducing in an automatic dishwashing machine the loss of a detergent composition due to leakage from the dispenser cup prior to its utilization for cleaning food-soiled dishware and cutlery during the washing step of the machine, which comprises adding to the dishwasher dispenser cup prior to the operation of the dishwasher the detergent compositions according to the invention.

DETAILED DESCRIPTION OF THE INVENTION

The minimum requirements for a gelled liquid detergent formulation are only a solvent (usually water), a thickener and a surfactant. It should be noted that the surfactant can act both as a thickener and a surfactant. However, in most automatic dishwasher detergents, the generation of foam is undesirable and most surfactants which produce gelling, also produce copious amounts of foam.

In accordance with the compositions of the present invention, almost any conventional aqueous system thickener can be used. Normally from about 0.1 to 20 weight percent of the aqueous thickener would be used. Although amounts in excess of 20 weight percent can be used, the need for such greater amounts would probably be rare and would only add to the cost of making the formulation. Amounts of less than about 0.1 weight percent would, in those cases, result in insufficient thickening of the gel for the purposes of obtaining the desired minimum yield point value. Typical examples of useful aqueous system thickeners can be described as follows:

I. Organic—Naturally Derived Type

Includes Alginates such as Carrageenan, agar, etc. and their salts; algin alkyl-carbonates, acetates, propionates and butyrates, etc.; Pectins, amylopectin, and derivatives; gelatin; starches and modified starches including alkoxylated forms such as esters, ethers, etc.; Cellulose derivatives such as sodium carboxymethylcellulose (CMC), hydroxyethylcellulose (HEC), carboxymethylhydroxyethyl cellulose (CMHEC), ethylhydroxyethyl cellulose (EHEC), methylcellulose (MC), etc.; Casein and its derivatives; Xanthomonas gums; Dextrans of low molecular weights; and Guar gums.

II. Organic—Synthetically Derived Type

Includes acrylic acid or methacrylic acid, and their metallic salts, esters, amides and/or polymers of any or all of these forms; copolymers of acrylic/methacrylic acids and/or their metallic salts, esters, amides, and/or polymers of any or all of these forms; organic amines, amides and polyamides (e.g. see U.S. Pat. No. 2,958,665); vinyl polymers such as substituted vinyls, vinyl ester polymers, etc.; metallic stearates especially of aluminum and zinc; castor oil derivatives; polyalkoxylated glycol ethers of high molecular weight; and amine salts of polycarboxylic acids (alginates, polyacrylates, glycolates, etc.).

III. Inorganic Type

Includes clays; fumed Aluminas and/or silicas; asbestos; silicates including alkali metal and alkaline-earth metal salts; and alkaline-earth metal metaphosphates.

IV. Combinations of Previously Mentioned Types (A) Includes resins prepared by crosslinking one or more of the above organic polymers with each other or with other polyhydric materials (aldehydes, alcohols, diols, ethers, etc.). For example:

(1) cross-linked 1:1 maleic anhydride-methyl vinyl ether copolymer with diethylene glycol divinyl ether or with 1,4-butanediol divinyl ether;
(2) methyl cellulose with glyoxal crosslinks;
(3) hydrolyzed polyacrylonitrile crosslinked with formaldehyde or acetaldehyde (e.g. see U.S. Pat. No. 3,060,124);
(4) polyacrylate polymers with maleic anhydride and styrene;
(5) carrageenan with cellulose methyl ether; and (B) Addition of certain inorganic salts to one or more of the above organic polymers. For example:

(1) calcium phosphate added to an aqueous solution of alginate salts;
(2) carageenan with alkali metal salts (e.g. KCl) added;
(3) increased gelation of gums or polyvinyl polymers by addition of borates;
(4) Xanthomonas gum with trivalent metal salts (e.g. $Al_2(SO_4)_3$) and a H-displacing metal (Zn or Ni).

(C) Aqueous dispersions of clays thickened with organic ammonium ions.

V. Surfactant Type (A) Includes addition of certain non-ionic surfactants to aqueous systems at above certain minimum concentrations to form gels; especially high alkoxylated (e.g. ethoxylated) non-ionics. This, in fact, is effective in any system able to form hydrogen bonding on a massive scale.

(B) Addition of certain anionic surfactants, especially phosphate esters, will form gels in aqueous media.

In addition to an aqueous system thickener, the detergent formulation of the present invention also contains from about 0.1 to 20 weight percent of a non-ionic surfactant. Amounts in excess of 20 weight percent can be used, however, such greater amounts are usually unnecessary and add to the cost of formulating the composition. Normally, amounts less than 0.1 weight percent would result in insufficient detersive properties for the composition. Typical examples of useful non-ionic surfactants are classified as follows:

I. Ethoxylated Alkyl Phenols

Compounds of the polyethylene oxide condensates of alkyl phenols such as the condensation products of alkyl phenols having an alkyl group containing from about 8 to 12 carbon atoms in either a straight chain or branched chain configuration with ethylene oxide in amounts such that the ethylene oxide content is 1 to 50 moles of ethylene oxide per mole of alkyl phenol. The alkyl substituant in such compounds may be derived from polymerized propylene, diisobutylene, octene or nonene for example.

II. Alkoxylated Aliphatic Alcohols

This class can include the condensation product of aliphatic alcohols having from 10 to 20 carbon atoms in either straight chain or branched chain configuration with usually 1 to 50 moles of ethylene oxide or propylene oxide as well as mixtures thereof. For example, ethoxylated-propoxylated aliphatic alcohols (sold under the tradename Plurafacs by Wyandotte Chemicals Corporation) and as disclosed in U.S. Pat. No. 3,504,041 which describes such compounds as having from about 0.1 to 10 weight percent of a compound having the general formula R—O(A)H wherein: R is an essentially linear alkyl group having from 10 to 18 carbon atoms, with the proviso that at least 70 weight percent of said compounds in said mixture have an R of from 12 to 16 carbon atoms, and A is a mixture of oxypropylene and oxyethylene groups, said oxypropylene and oxyethylene groups being from 55 percent to 80 percent of total weight of the compounds, the oxypropylene to oxyethylene ratio of said total weight being from 0.85:1 to 2.75:1. Another example would be a coconut alcoholethylene oxide condensate having from 5 to 30 moles of ethylene oxide per mole of coconut alcohol, the coconut alcohol fraction having from 10 to 14 carbon atoms.

III. Carboxylic Esters

This class can include glycerol esters; polyethylene glycol esters (i.e. fatty acid esters with polyethylene oxide); anhydrosorbitol esters; ethoxylated anhydrosorbitol esters; glycol esters of fatty acids; ethoxylated natural fats, oils, and waxes.

IV. Carboxylic Amides

This class can include the ammonia, monoethanol and diethanolamides of fatty acids having an acyl moiety of from about 8 to 18 carbon atoms. These acyl moieties are normally derived from naturally occurring glycerides, e.g. coconut oil, palm oil, soybean oil and tallow, but can be derived synthetically, e.g. by the oxidation of petroleum or by hydrogenation of carbon monoxide Fischer-Tropsch Process. The fatty acid diethanolamides can be "regular" (with amine/acid ratio of 2:1) or "super" (with amine/acid ratio of 1:1).

V. Polyethoxylated Fatty Acid Amides

This class can include ethoxylated mono- and diamides.

VI. Polyalkylene Oxide Block Copolymers

This class can include polyethoxylated-polypropoxylated propylene glycol sold under the tradename "Pluronic" made by the Wyandotte Chemicals Corporation or polypropoxylated-polyethoxylated ethylene glycol sold under the tradename "Pluronic R" made by the Wyandotte Chemicals Corporation. The first group of compounds are formed by condensing ethylene oxide with a hydrophobic base formed by the condensation of propylene oxide with propylene glycol (see U.S. Pat. No. 2,674,619). The hydrophobic portion of the molecule which, of course, exhibits water insolubility, has a molecular weight from about 1500 to 1800. The addition of the polyoxyethylene radicals to this hydrophobic portion tends to increase the water solubility of the molecule as a whole and the liquid character of the product is retained up to the point where the polyoxyethylene content is about 50 percent of the total weight of the condensation product. The latter series of compounds called "Pluronic R" are formed by condensing propylene oxide with the polyethoxylated ethylene glycol condensate. This series of compounds is characterized by having an average molecular weight of about between 2000 and 9000 consisting of, by weight, from about 10 to 80 weight percent polyoxyethylene, and a polyoxypropylene portion having a molecular weight between about 1000 and 3100.

VII. Polyalkoxylated organosilicone Polymers

This class can include, for example, compounds having the formula:

$$C_2H_3Si[O(Si(CH_3)_2O)_z(CH_2CH_2O)_x(C_3H_6O)_yC_4H_9]_3$$

made by the Union Carbide Corporation and identified typically by L-520 and L-720.

To the basic gel detergent system comprising a thickener and a non-ionic surfactant and water, can be added various builder substances for increasing the cleaning efficiency of the composition. Usually, about 1 to 70 weight percent of a builder can be utilized which can include sequesterants for removal of food soil from the dishware that is cleaned, as well as chelating or complexing undesirable metal ions in the dishwasher water; and various akalinity builders for controlling the pH of the wash water.

Among the sequesterants that can be used are sodium tripolyphosphate, trisodiumnitrilotriacetate (i.e. $Na_3NTA$), tetrasodiumethylenediamine-tetraacetate, sodium citrate and the corresponding potassium salts thereof. A preferred sequestering agent is tetrapotassium pyrophosphate or tetrasodium pyrophosphate (i.e. TSPP).

Among the alkalinity builders that can be used are caustic soda, carbonates, phosphates, ammonia or amines, borates, etc.

Additionally, other substances can be added to the detergent formulation which includes corrosion inhibitors (e.g. sodium silicate, benzotriazole, and sodium aluminate); as well as chlorine-releasing compounds; and perfumes or dyes.

A preferred embodiment of the dishwasher detergent composition contains from about 0.1 to 20 weight percent of an aqueous thickener; 0.1 to 20 weight percent of a non-ionic surfactant; 1 to 20 weight percent of a corrosion inhibitor; 1 to 70 weight percent of a builder; and the remaining portion constituting water.

In another preferred embodiment, a composition comprising from about 0.1 to 5 weight percent of sodium carboxymethylcellulose; 1 to 20 weight percent of sodium silicate; 0 to 40 weight percent of tetrasodium pyrophosphate; 1 to 30 weight percent of trisodium nitrilotriacetate monohydrate; 10 to 95 weight percent water; and a non-ionic surfactant selected from the group consisting of:

(a) from about 0.1 to 10 weight percent of polypropoxylatedpolyethoxylated ethylene glycol having an average molecular weight between about 2100 and 3100, that consists of, by weight, from about 20 to 40 weight percent polyoxyethylene, and a polyoxypropylene portion having a molecular weight between about 1700 and 2500;

(b) from about 0.1 to 10 weight percent of a compound having the general formula R—O(A)H wherein: R is an essentially linear alkyl group having from 10 to 18 carbon atoms, with the proviso that at least 70 weight percent of said compounds in said mixture have an R of from 12 to 16 carbon atoms, and A is a mixture of oxypropylene and oxyethylene groups, said oxypropylene and oxyethylene groups being from 55 percent to 80 percent of total weight of the compounds, the oxypropylene to oxyethylene ratio of said total weight being from 0.85:1 to 2.75:1; and (c) mixtures thereof.

During early development work it was found that gelled detergents could be prepared that would leak from the dispenser cups of the dishwasher less than the granular solid detergents. It certainly was unexpected to find that an aqueous solution of soluble ingredients could be made to wash out of the dispenser less than solid materials.

Investigating the reasons for the unusual behavior of the gels, it became surprisingly apparent that the degree of cup retention of the gels was not dependent on the viscosity but more on the degree of cohesiveness of the material, i.e., its ability to hold itself together, its gelatinousness. Such a property is the "Yield Value" of a gel. Defined by Webster as "the minimum shearing or normal stress required to produce continuous deformation in a solid". The Yield Value indicates the resistance of a gel to flow from an "at rest" position and is different, therefore, from the "viscosity", which measures the resistance to flow under dynamic, or flowing conditions. It was found that the cup retentive property of the gels did indeed follow the change in Yield Value of the products. In Example I, which follows shortly, can be seen the dependence of the cup retention of the gels on the Yield Value rather than the viscosity. Shown are two (2) sets of two (2) gel formulations each, with their viscosities, Yield Values, and Cup Retention Values. Although the cup retention of the two (2) sets were run with different water temperatures, the results of each set are the same. The gels had similar viscosities, but different Yield Values, and the gel with the higher Yield Value was retained better in the cup.

There are many ways to produce a gel system, but the cup retentive properties were not found to be dependent on the ingredients employed, only on the resulting Yield Value, which was determined as described below.

Test Methods (A) Viscosity: All viscosities of products were measured on a Brookfield Model LVT Synchro-Lectric Viscometer using appropriate speeds and spindles as suggested by the manufacturer. With very gelatinuous materials, with which there is a tendency for the spindle to "bore" a hole in the sample and thus give erroneous readings, the Brookfield Viscometer was supported on a Brookfield Helipath Stand (Model C) and the corresponding spindles were used. The Helipath stand slowly lowers the viscometer spindle deeper into the sample so the spindle continuously encounters fresh sample. All viscosities are read at 25° C. just prior to testing the sample for cup retention.

(B) Yield Value: Our values are determined in a manner analagous to that supplied by the Brookfield Engineering Laboratories, except the viscosities are determined at slightly different speeds. The viscosities are determined, as described above, at 0.3 and 0.6 rpm spindle speeds. At these speeds very little shear is placed on the sample. The values are then applied in the formula:

$$\text{Yield Value} = \frac{(\text{apparent Viscosity at 0.3 rpm}) - (\text{apparent Viscosity at 0.6 rpm})}{100}$$

where the viscosities are given in centipoises.

(c) Cup Retention: Unless otherwise noted, all retention values given herein were determined in the G.E. Model 250 dishwasher, containing a complete 4-place setting of ceramic tableware with meat platter and 2 vegetable bowls (to give realistic water dispersion in the dishwasher), and supplied with Cincinnati tap water controlled to 140° F. incoming temperature. The closed detergent dispenser on this G.E. model is of the swinging-cup type and represents one of the most popular models found in residential homes as well as providing the most difficult comparison of powdered detergents versus the gel formulations of the invention insofar as cup retention properties are concerned. An accurately-weighed 30 milliliter sample of gel or powder is placed in the closed dispenser cup. The machine is closed and run through the normal cycle. When the water begins to fill into the machine for the second wash cycle, the operation is interrupted, the machine opened, and the remaining product scraped from the dispenser. This residue is re-weighed to determine the amount lost prior to the second wash cycle. The "% Cup Retention" is calculated. The procedure is duplicated and results averaged. With powdered samples the damp residue must be dried at 110° C. for 2 hours, then reweighed. Using the "% moisture" determined on a fresh sample of powder, the weight of the dried residue can be calculated to the corresponding weight of powder. From this weight, the "% retention" can be determined.

EXAMPLE I

VISCOSITY VS. YIELD VALUE FOR GEL CUP RETENTION

Viscosity values were determined for the following detergent gels by the method previously described using a Brookfield Synchro-Lectric ®Viscometer, Model LVT. Cup retention values were determined in a G.E. Model 250 dishwasher at the water temperatures below using Cincinnati tap water (140 ppm hardness as $CaCo_3$).

All formulations are listed by Weight Percent

| | 170° F. Water Temperature (Uncontrolled) | | 140° F. Water Temperature (Controlled) | |
|---|---|---|---|---|
| Formulations | A | B | C | D |
| Water, deionized | 46.08 | 53.3 | 46.61 | 44.51 |
| CMC-7HF | .70 | .7 | .70 | .70 |
| *Starso ® silicate | 15.00 | 15.0 | 15.00 | 15.00 |
| *50% NaOH (aq.) | 4.22 | 0 | 3.69 | 5.79 |
| Pluronic 25R2 | 6.00 | 4.0 | 6.00 | 6.00 |
| Purafac RA 30 | 0 | 2.0 | 0 | 0 |
| pyrophosphate | 21.00 | 20.0 | 21.00 | 21.00 |
| Trisodium NTA | 7.00 | 5.0 | 7.00 | 7.00 |
| | 100.00% | 100.0% | 100.00% | 100.00% |
| Viscosity at 0.3 rpm | 414,000 cps | 426,000 cps | 468,000 cps | 472,000 cps |
| Yield Value | 1090 | 1300 | 1320 | 1170 |
| Avg. Cup Retention | 73.3% | 90.0% | 91.7% | 89.7% |

*Starso ® silicate and 50% NaOH premixed prior to addition to the formulation.

It was necessary to determine the minimum Yield Value at which the cup retention of a gelled detergent system surpassed that of a powdered detergent.

The average cup retentions of two commercial powdered dishwasher detergents, one "agglomerated" type and one "dry-mix" type, were measured. The two products tested were CASCADE ® (agglomerated) and Electra-Sol ® (dry-mixed).

An analysis of the active ingredients of CASCADE ® gave the following composition:

| Item | % Weight |
|---|---|
| Sodium tripolyphosphate | 43.0 |
| Sodium silicate | 13.5 |
| Chlorinated trisodium phosphate | 20.0 |
| Surfactant | 2.0 |
| Water of hydration | 21.5 |
| | 100.0% |
| Sodium silicate: $SiO_2NA_2O$ ratio = 2.76 | |

To these basic ingredients are also added slight amounts of dye and perfume for colorant and odor, respectively. All of these ingredients are slurried together in water and tumbled while drying off the excess moisture. This "agglomeration" process results in a granular product, each bead of which is uniform in composition. The CASCADE® was tested for cup retention, by the above method, and an average value of 90.2% retention was obtained for triplicate determinations.

To the best of Applicants' knowledge, Electra-Sol® detergent can be described as having an appropriate composition of: sodium tripolyphosphate with an 8.7% total phosphorus content in the product, sodium carbonate (a filler and alkalinity builder), sodium silicate (ratio unknown). Tests also confirm the presence of some chlorinating agent. This product is simply a dry blend of the individual powdered components. Virtually, no moisture is present, which would lead one to suspect that chlorinated isocyanurates are used as the chorinating agent. An average cup retention of 90.1% was obtained from triplicate determinations for this product.

A series of gelled liquid detergent formulations were prepared as shown in Example II, which follows shortly, with very similar compositions. Slight alterations in the formulas were necessary to develop different Yield Values in the gels. The Yield Value of these gels ranged from 260 to 2810 and the corresponding cup retentions from 82.7% to 97.55%.

From the least squares fit of the data of Example II, as analyzed by a computer using a Non-Linear Regression Analysis for a Parabolic Fit, the minimum Yield Value needed to surpass the best powdered detergent, CASCADE®, at 90.2% retention is 1170 (±85).

EXAMPLE II

| Formulation | 1 | 2 | 3 | 4 |
|---|---|---|---|---|
| Ingredient | | | | |
| D.I. Water | 42.41% | 50.30% | 44.51% | 46.61 |
| CMC 7HF | .70 | .70 | .70 | .70 |
| Starso Silicate | 15.00 | 15.00 | 15.00 | 15.00 |
| 50% NaOH | 7.89 | — | 5.79 | 3.69 |
| Pluronic 25R2 | 6.00 | 6.00 | 6.00 | 6.00 |
| TSPP | 21.00 | 21.00 | 21.00 | 21.00 |
| $Na_3NTA$ | 7.00 | 7.00 | 7.00 | 7.00 |
| Carbopol 940 | — | — | — | — |
| Triton X-45 | — | — | — | — |
| | 100.00% | 100.00% | 100.00% | 100.00% |
| Yield Value | 260 | 530 | 1170 | 1320 |
| Avg. Cup Retention | 82.7% | 84.3% | 89.7% | 91.7% |
| **Formulation** | **5** | **6** | **7** | **8** |
| Ingredient | | | | |
| D.I. Water | 48.80% | 47.66% | 49.78% | 95.17% |
| CMC 7HF | .70 | .70 | .70 | — |
| Starso Silicate | 15.00 | 15.00 | 15.00 | — |
| 50% NaOH | 1.50 | 2.64 | .52 | .33 |
| Pluronic 25R2 | 6.00 | 6.00 | 6.00 | — |
| TSPP | 21.00 | 21.00 | 21.00 | — |
| $Na_3NTA$ | 7.00 | 7.00 | 7.00 | — |
| Carbopol 940 | — | — | — | .50 |
| Triton X-45 | — | — | — | 4.00 |
| | 100.00% | 100.00% | 100.00% | 100.00% |
| Yield Value | 1340 | 1420 | 1710 | 2810 |
| Avg. Cup Retention | 91.8% | 92.5% | 92.8% | 97.55% |

An experiment was run to verify that the gel form, and not the detergent ingredients, was responsible for the superior cup retention. The same detergent ingredients used to make a gelled product were used to make a powder, without the water. These two products were tested for cup retention. The formulae and results are given in Example III.

EXAMPLE III

| Ingredients | Gel Parts (wt.) | Powder Parts (wt.) |
|---|---|---|
| $H_2O$ | 58.27 | 0 |
| CMC-7HF | .70 | .70 |
| *Sodium silicate solids | 7.03 | 7.03 |
| Pluronic 25R2 | 6.00 | 6.00 |
| Tetrasodium Pyrophosphate | 21.00 | 21.00 |
| Trisodium Nitrilotriacetate | 7.00 | 7.00 |
| | 100.00 parts | 41.73 parts |
| Yield Value = | 1320 | (not applicable) |
| Cup Retention at 140° F. (avg.) | 91.7% | 71.5% |

*Sodium silicate prepared by premixing higher ratio silicates with sodium hydroxide to generate a silicate solids with an $SiO_2/Na_2O$ ratio of 1.10.

From the great difference in cup retention of these two products, it would appear that the physical form (i.e. gel or powder) of the detergent formulation rather than the specific ingredients determines the degree of cup retention. In fact, the ingredients used in these formulations are much more soluble than those which would normally be used in a powdered formulation. Hence, the lower cup retention of the powdered form compared with commercial powdered products. Nevertheless, the gelled product, with the Yield Value above the minimum value previously established, provided cup retention superior to its powdered form, as well as to the commercial products.

In Examples IV–IX are presented gel dishwasher detergent formulations according to the invention containing various types of thickeners and surfactants exemplifying those earlier discussed.

EXAMPLE IV

Type II. Thickener: Organic—synthetically derived: Carbopol® 940

Type I. Surfactant: Ethoxylated alkylphenols: Triton X45

| Formulations | E | F |
|---|---|---|
| Water, deionized | 93.84 | 95.27 |
| Carbopol® 940 | .50 | .17 |
| 10% aq. NaOH | 1.66 | .56 |
| Triton X45 | 4.00 | 4.00 |
| | 100.00% | 100.00% |
| Yield Value | 2810 | 810 |
| Cup Retention (avg.) | 97.55% | 88.6% |

EXAMPLE V

Type III. Thickener: Inorganic: "Hi-Gel"

Type IV. Surfactant: Carboxylic amides: Richamide-M3

| Formulations | G | H |
|---|---|---|
| Water, deionized | 76 | 80 |
| Richamide-M3 | 4 | 4 |
| Hi-Gel | 10 | 14 |
| $Na_3NTA$ | 10 | 2 |
| Yield Value | 300 | 1390 |
| Cup Retention (avg.) | 79.2% | 90.8% |

EXAMPLE VI

Type IV. Thickener: Combinations: Aqueous dispersion of clay (Bentonite BC) thickened with organic ammonium ions (triethanolamine)

Type II. Surfactant: Alkoxylated aliphatic alcohols: Neodol 23-3

The same formulation was used. The product was allowed to age and, due to the unstable condition of its gel network, the Yield Value dropped with aging. Retention tests were run on a fresh sample, while the Yield Value was high, and again on an aged sample when the Yield Value dropped lower.

| Formulations | Fresh | Aged |
|---|---|---|
| Water, deionized | 84 | 84 |
| Bentonite BC | 8 | 8 |
| Triethanolamine | 5 | 5 |
| 50% aq. NaOH | 2 | 2 |
| Neodal 23-3 | 1 | 1 |
| Yield Value | 1480 | 660 |
| Cup Retention (avg.) | 92.4% | 85.2% |

EXAMPLE VII

Type V. Thickener: Surfactants: Micro-Emulsion gels with a phosphate ester (Crodafos N.10) and an ethoxylated fatty alcohol (Volpo 3), and propylene glycol as a gel modifier and clarifier.

Type III. Surfactant: Carboxylic ester: Span 80

| Formulations | I | J |
|---|---|---|
| Water, deionized | 76 | 71.6 |
| "Gloria" mineral oil | 9 | 10.8 |
| Propylene glycol | 3 | 3.6 |
| Crodafos N.10 | 5 | 6.0 |
| Volpo 3 | 5 | 6.0 |
| Span 80 | 2 | 2.0 |
| Yield Value | 680 | 1380 |
| Cup Retention (avg.) | 86.6% | 92.4% |

EXAMPLE VIII

Type I. Thickener: Organic—natural: Sodium CMC (CMC-7HF)

Type VII. Surfactant: Polyalkoxylated Organosilicone Polymer (L-720)

| Formulations | K | L |
|---|---|---|
| Water, deionized | 80.0 | 73.6 |
| CMC-7HF | 1.3 | 1.8 |
| Sodium citrate, dihydrate | 6.7 | 8.8 |
| Tetrasodium pyrophosphate | 10.0 | 13.2 |
| L-720 | 2.0 | 2.6 |
| | 100.00% | 100.00% |
| Yield Value | 800 | 2370 |
| Cup Retention (avg.) | 87.8% | 97.5% |

EXAMPLE IX

Type I. Thickener: Organic—natural: Sodium CMC (CMC-7HF)

Type V. Surfactant: Polyethoxylated Fatty Amides: Amidox C-5

-continued

| Formulations | M | N |
|---|---|---|
| Water, Deionized | 80.4 | 73.5 |
| CMC-7HF | 1.3 | 1.8 |
| Sodium citrate, dihydrate | 6.5 | 8.8 |
| Tetrasodium Pyrophosphate | 9.7 | 13.1 |
| Amidox C-5 | 2.1 | 2.8 |
| | 100.00% | 100.00% |
| Yield Value | 506 | 1820 |
| Cup Retention (avg.) | 81.1% | 94.05% |

A procedure was used to determine the efficacy of dishwasher detergent formulations utilizing a slight modification of a method developed by BASF Wyandotte Corporation; also a slightly different grading scale is used to evaluate the results. Generally, this procedure is only a slight modification of the "Tentative Spotting and Filming Test In Home Dishwashing Machines" developed by Sub-Committee C of the Scientific Committee in the Soap, Detergent and Sanitary Chemical Products Division of the Chemical Specialties Manufacturers Association, Inc. in 1957 and used widely in the detergent's industry since then as a standard method. The only significant differences between our method and the CSMA method is the soil composition and the grading scale used.

Soil Composition (Parts by Weight)

⅔ oleomargarine ("Blue Bonnet" brand)
1/6 non-fat dry milk solids ("Carnation" brand)
1/6 cooked Wheatena mixture*

* Wheatena preparation: Cook a mixture of 45 g. of Wheatena cereal (Standard Milling Co., Kansas City, Mo.) and 228 g. water at a boil for 5 minutes. Then add 600 g. of milk, prepared by mixing 100 g of non-fat powdered dry milk with 500 g. water, to the hot Wheatena. Stir and allow to cool to room temperature.

Soil Preparation

Heat oleomargarine until almost completely molten. Stir in the non-fat dry milk solids and the cooked Wheatena mixture. Mix until a uniform paste is obtained. This soil may be used immediately or stored for several days in the refrigerator.

Glasses and Dishes 5 drinking glasses—10½ fl. ounces; 2¾" dia.×5⅛" high
10 dinner plates—12" dia. standard chinaware.
10 dinner plates—12" dia. Melamine ware.

Test Procedure:

1. Spread 40 g. of the soil mixture evenly onto 6 of the Melamine plates.
2. Allow the soil to "age" about 15 minutes in the room atmosphere.
3. Place the soiled plates alternately among the remaining 4 Melamine and 10 china plates in the lower rack of the dishwasher.
4. Place the 5 drinking glasses, which have previously been examined to be free of spots, haze, or streaks in the upper rack of the dishwasher.
5. Place 20 milliliters of the detergent being tested into each of the two dispenser cups (total 40 milliliters) of the dishwasher. The machine is run through the complete cycle. Ideally the feed water to the machine is regulated to maintain a certain temperature, usually 140° F. At any instance, the temperature of the water is recorded with the results.
6. After the drying cycle is complete, the glasses are allowed to cool about to room temperature and are then rated for spot coverage on a 0.0 to 10.0 linear scale (i.e.

0=no spots, 1=10% spotted, etc. to 10=100% spotted). The spotting value of each glass is recorded and a notation is made if excessive hazing or filming is apparent.

The entire procedure is repeated until 15 cycles have been run with the glasses. The build-up of spotting can then be noted over the 15 cycles. The overall spotting performance is determined by standard statistical treatments of the data, from the 15 cycles, usually by analysis of variance, between all detergents tested in that test series. If the test detergent is being compared to other formulations, an appropriate number of dishwashers is used and after each cycle each detergent and its 5 glasses are rotated to one of the other machines so that after the 15 cycles have been completed, each product has been run the same number of times in each machine. This procedure eliminates the variable caused by the slight differences in dishwashers, even if identical models are used.

EXAMPLE X

CASCADE ® and gel detergent formulations O and P, having the chemical compositions given below, were tested for their cleaning performance by the procedure previously described.

| Formulations | O | P |
|---|---|---|
| Water, deionized | 50.30 | 43.73 |
| CMC-7HF | 0.70 | 0.70 |
| Starso ® sodium silicate | 15.00 | — |
| *Star ® sodium silicate | — | 15.07 |
| *50% aqueous NaOH | — | 6.50 |
| Pluronic ® 25R2 | 4.00 | 4.00 |
| Plurafac ® RA30 | 2.00 | 2.00 |
| Tetrasodium pyrophosphate | 21.00 | 21.00 |
| $Na_3NTA$ | 7.00 | 7.00 |
| Yield Value | 2220 | 1200 |

*Note: In Formulation P, the sodium silicate and aqueous sodium hydroxide solution are premixed to give a $SiO_2/Na_2O$ ratio of 1 prior to preparing the resultant formulation.

The water supply temperature was 160° F. and Cincinnati tap water was used having an average hardness of 190 parts per million as $CaCO_3$. Kitchenaid (Model KDR-66) dishwasher machines were used to wash the soiled plates and glassware in accordance with the previously described method.

The rating values for spotting of glasses are given below.

| Cycle | Cascade | P | O |
|---|---|---|---|
| 1 | 0.0 | 0.0 | 0.4 |
| 2 | 0.2 | 0.0 | 0.2 |
| 3 | 0.4 | 0.0 | 0.0 |
| 4 | 0.2 | 0.0 | 0.2 |
| 5 | 0.8 | 0.0 | 0.0 |
| 6 | 0.6 | 0.0 | 0.2 |
| 7 | 0.0 | 0.0 | 0.0 |
| 8 | 0.2 | 0.0 | 0.0 |
| 9 | 0.0 | 0.0 | 0.0 |
| 10 | 0.4 | 0.0 | 0.0 |
| 11 | 0.6 | 0.0 | 0.0 |
| 12 | 0.4 | 0.0 | 0.0 |
| 13 | 0.2 | 0.0 | 0.0 |
| 14 | 0.4 | 0.0 | 0.0 |
| 15 | 0.2 | 0.0 | 0.0 |
| Avg. | 0.30 | 0.00 | 0.07 |

Using an analysis of variance statistical procedure, the following confidence parameters were established:

Least Significant Difference=0.114

Therefore,

Cascade=0.30±0.06

Formulation P=0.00±0.06

Formulation O=0.07±0.06

Showing that both gels were significantly better cleaners in this test.

All chemical compositions are given in weight percent unless otherwise specified. Also, the examples are presented to illustrate the present invention and are only examplary and not limiting of the scope of the present invention.

In the examples and throughout the disclosure, the following terms have the meaning described below unless otherwise stated:

Amidox C5: (Stepan Chemical Company)—an ethoxylated fatty amide, specifically a coconut fatty amide (amine used unknown) ethoxylated with 5 moles of ethylene oxide.

Bentonite BC: (American Colloid Co.)—a high-purity, air floated form of Wyoming bentonite composed of micron-sized particles only; a mineral clay, specifically a hydrous silicate of alumina; essentially all montmorillonite.

Carbopol ® 940: (B. F. Goodrich Chemical Co.)—a proprietary acrylic polymer; composition unknown.

CMC 7HF: (Hercules, Inc.)—a high viscosity form (food grade) of sodium carboxymethylcellulose with a "degree of substitution" of 0.7.

Crodafos N.10: (Croda Incorporated)—a phosphate ester surfactant, more specifically a complex oleyl ether phosphate. The oleyl alcohol used to make this material has been ethoxylated with 10 moles of ethylene oxide. The phosphate ester contains 60% (±10%) monoester and 40% (±10%) diester. This material has been neutralized with diethanolamine to pH 7.

"Gloria" Mineral Oil: (Witco Chemical -Sonneborn Div.)—a white, USP-grade, mineral oil, composed entirely of saturated aliphatic and naphthenic hydrocarbons. "Gloria" has a saybolt viscosity range at 100° F. of 200–210 seconds.

"Hi-Gel": (American Colloid Co.)—identical in composition to Bentonite BC, only pretested and selected to provide higher viscosities in solution than the BC.

L-720: (Union Carbide, Silicone Div.)—an alkoxylated organosilicone polymer

Neodol 23-3: (Shell Chemical Co.)—an ethoxylated aliphatic alcohol surfactant; specifically, the 3 mole ethoxylate of a mixture of straight chain, synthetic alcohols with carbon chain lengths of 12 and 13.

Plurafac RA 30: (BASF Wyandotte) —a polyethoxylated fatty (straight-chain) alcohol "end-blocked" by propylene oxide addition and having the general formula believed to be:

$$CH_3—(CH_2)_x—O—(C_2H_4O)_y—(C_3H_6O)_z—H$$

Pluronic 25R2: (BASF Wyandotte)—a "Pluronic R" type surfactant having an average molecular weight of 3120, containing 20 weight percent polyoxyethylene, and a polyoxypropylene portion having a molecular weight of 2500.

Richamide M3: (Richardson Company)—a diethanolamide of a coconut fatty acid; a "superamide", i.e., a 1:1 ratio of fatty acid and amine were reacted to make the amide.

Span 80: (ICI Organic)—a fatty acid ester surfactant, specifically sorbitan monooleate.

Star® silicate solution: (Philadelphia Quartz Co.-)—A specially clarified aqueous solution of sodium silicate with an $SiO_2/Na_2O$ ratio of 2.50, and containing 37.1% actives.

Starso® silicate solution: (Philadelphia Quartz Co.-)—a specially clarified, aqueous solution of sodium silicate with an $SiO_2/Na_2O$ ratio of 1.80, and containing 37.5% actives.

Triton X 45: (Rohm & Haas)—an ethoxylated alkylphenol; specifically the 3 mole ethoxylate of octylphenol.

Volpo 3: (Croda Incorporated)—an ethoxylated fatty alcohol; specifically the 3 mole ethoxylate of oleyl alcohol.

What is claimed:

1. A low-foaming machine dishwashing composition consisting essentially of:

(a) from about 0.1 to 20 weight percent of an aqueous thickener;

(b) from about 0.1 to 20 weight percent of a non-ionic surfactant; and (c) water, said composition being in the form of a gel characterized as having a yield point of at least about 1170.

2. The composition as claimed in claim 1 additionally containing a builder.

3. The composition as claimed in claim 2 consisting essentially of from about 0.1 to 20 weight percent of an aqueous thickener; 0.1 to 20 weight percent of a non-ionic surfactant; 1 to 20 weight percent of a corrosion inhibitor; 1 to 70 weight percent of a builder; and the remaining portion constituting water.

4. The composition as claimed in claim 3 consisting essentially of from about 0.1 to 5 weight percent of sodium carboxymethylcellulose; 1 to 20 weight percent of sodium silicate; 0 to 40 weight percent of tetrasodium pyrophosphate; 1 to 30 weight percent of trisodium nitrilotriacetate monohydrate; 10 to 95 weight percent water; and a nonionic surfactant selected from the group consisting of:

(a) from about 0.1 to 10 weight percent of polypropoxylatedpolyethoxylated ethylene glycol having an average molecular weight between about 2100 and 3100, that consists of, by weight, from about 20 to 40 weight percent polyoxyethylene, and a polyoxypropylene portion having a molecular weight between about 1700 and 2500;

(b) from about 0.1 to 10 weight percent of a compound having the general formula R-O(A)H wherein: R is an essentially linear alkyl group having from 10 to 18 carbon atoms, with the proviso that at least 70 weight percent of said compounds in said mixture have an R of from 12 to 16 carbon atoms, and A is a mixture of oxypropylene and oxyethylene groups, said oxypropylene and oxyethylene groups being from 55 percent to 80 percent of total weight of the compounds, the oxypropylene to oxyethylene ratio of said total weight being from 0.85:1 to 2.75:1; and (c) mixtures thereof.

5. A method for reducing in an automatic dishwashing machine the loss of a detergent composition due to leakage from the dispenser cup prior to its utilization for cleaning food-soiled dishware and cutlery during the washing step of the machine, which comprises adding to the dishwasher dispenser cup prior to the operation of the dishwasher the detergent composition claimed in claim 1.

6. The method of claim 5 wherein said composition comprises that claimed in claim 2.

7. The method of claim 6 wherein said composition comprises that claimed in claim 3.

8. The method of claim 7 wherein said composition comprises that claimed in claim 4.

* * * * *